US006390698B1

(12) United States Patent
Yoshida et al.

(10) Patent No.: US 6,390,698 B1
(45) Date of Patent: May 21, 2002

(54) APPARATUS AND METHOD OF DETECTING HOME POSITION OF CARRIAGE AND STORAGE MEDIUM STORING HOME POSITION DETECTION PROGRAM

(75) Inventors: Masanori Yoshida; Hitoshi Igarashi, both of Nagano-Ken (JP)

(73) Assignee: Seiko Epson Corporation, Tokyo (JP)

( * ) Notice: Subject to any disclaimer, the term of this patent is extended or adjusted under 35 U.S.C. 154(b) by 91 days.

(21) Appl. No.: 09/661,055

(22) Filed: Sep. 13, 2000

(30) Foreign Application Priority Data

Sep. 24, 1999 (JP) ..... 11-270944
Jun. 5, 2000 (JP) ..... 2000-167918

(51) Int. Cl.[7] ..... B41J 11/22
(52) U.S. Cl. ..... 400/356; 400/283; 400/355
(58) Field of Search ..... 400/356, 355, 400/283

(56) References Cited

U.S. PATENT DOCUMENTS 5,116,150 A 5/1992 Courtney
5,825,381 A * 10/1998 Choo ..... 347/19

FOREIGN PATENT DOCUMENTS

EP 641 665 3/1995
EP 659 572 6/1995
GB 2 170 934 A * 8/1986
JP 403268976 A * 11/1991
JP 407040621 A * 2/1995

* cited by examiner

*Primary Examiner*—Andrew H. Hirshfeld
*Assistant Examiner*—Charles H. Nolan, Jr.
(74) *Attorney, Agent, or Firm*—Sughrue Mion, PLLC

(57) ABSTRACT

There is provided an apparatus and a method of detecting a home position of a carriage, achieving a less manufacturing cost. The apparatus includes a position detecting part to detect a position of a carriage driven by a motor; a first drive control part to control the motor so that the carriage is transferred toward a frame of a printer until being stopped, the frame being provided at a home position range side; a second drive control part to control the motor so that the carriage is transferred toward another frame of the printer until being stopped, the other frame being provided opposite to the frame provided at the home position range side; a third drive control part to control the motor so that the carriage is transferred to a predetermined position close to the home position range; and a selection control part to select one of the first, the second, and the third drive control parts and control the selected drive control part, thus detecting a home position of the carriage based on a result of the selective control and the output of the position detecting part.

21 Claims, 10 Drawing Sheets

APPARATUS AND METHOD OF DETECTING HOME POSITION OF CARRIAGE AND STORAGE MEDIUM STORING HOME POSITION DETECTION PROGRAM

BACKGROUND OF THE INVENTION

1. Field of the Invention

The present invention relates an apparatus and a method of detecting the home position of a carriage.

2. Description of Related Art

In a typical serial printer such as an ink jet printer, a recording head scans on a printing paper to print. This recording head is fixed to a carriage to move with the carriage. This carriage is driven by a DC(Direct Current) motor. The system for driving the carriage is as follows.

First, a timing belt is stretched at a predetermined tension between a driving pulley, which is fixed to the rotating shaft of the DC motor, and a driven wheel which is a companion to the driving pulley. The carriage is mounted on the timing belt. Thus, the carriage is driven by the rotation of the DC motor so as to move main scanning directions.

For such ink jet printers, the location of a carriage at its home position or another at power-on affects maintenance of the printers.

The location of a carriage located at the home position at power-on indicates that the previous printing process finished in which an ink-injecting nozzle has been covered with a cap.

On the other hand, the location of a carriage located at another other than the home position at power-on indicates that the previous printing process finished in which an ink-injecting nozzle has not been covered with a cap, thus requiring sucking-up ink from the nozzle before printing.

Ink jet printers have employed a sensor for solo use in detecting the position of a carriage at the home or another position. Such a sensor is not so expensive, however, a manufacturing cost is high for a large number of printers to be shipped with such sensors.

SUMMERY OF THE INVENTION

It is therefore an object of the present invention to eliminate the aforementioned problems and to provide an apparatus and a method of detecting the home position of a carriage with a low cost of printer manufacture, and a storage medium storing a home position detecting program.

The present invention provides an apparatus for detecting a home position of a carriage including: a position detecting part to detect a position of a carriage driven by a motor; a first drive control part to control the motor so that the carriage is transferred toward a frame of a printer until being stopped, the frame being provided at a home position range side; a second drive control part to control the motor so that the carriage is transferred toward another frame of the printer until being stopped, the other frame being provided opposite to the frame provided at the home position range side; a third drive control part to control the motor so that the carriage is transferred to a predetermined position close to the home position range; and a selection control part to select one of the first, the second, and the third drive control parts and control the selected drive control part, thus detecting a home position of the carriage based on a result of the selective control and the output of the position detecting part.

The apparatus for detecting a home position of a carriage as configured above is capable of home position detection with no detector for solo use in home position detection, thus achieving less manufacturing cost.

Furthermore, the present invention provides a method of detecting a home position of a carriage including the steps of: a first step of transferring a carriage driven by a motor toward a frame of a printer until being stopped, the frame being provided at a home position range side; a second step of obtaining a first stop position at which the carriage stops by the first step and a first transfer distance from a position at which the carriage starts to transfer to the first stop position, based on an output of a position detecting part for detecting a position of the carriage; a third step of transferring the carriage toward another frame of the printer until being stopped, the other frame being provided opposite to the frame provided at the home position range side; a fourth step of obtaining a second stop position at which the carriage stops by the third step and a second transfer distance in which the carriage transfers from the first stop position to the second stop position, based on the output of the position detecting part; and a fifth step of setting an initial position of the carriage in the home position range based on the second transfer distance and the first stop position.

The method of detecting a home position of a carriage as configured above is capable of home position detection with no detector for solo use in home position detection, thus achieving less manufacturing cost.

Moreover, the present invention provides a computer-readable storage medium storing program code for detecting a home position of a carriage, including: first program code means for transferring a carriage driven by a motor toward a frame of a printer until being stopped, the frame being provided at a home position range side; second program code means for obtaining a first stop position at which the carriage stops by the first program code means and a first transfer distance from a position at which the carriage starts to transfer to the first stop position, based on an output of a position detecting part for detecting a position of the carriage; third program code means for transferring the carriage toward another frame of the printer until being stopped, the other frame being provided opposite to the frame provided at the home position range side; fourth program code means for obtaining a second stop position at which the carriage stops by the third program code means and a second transfer distance in which the carriage transfers from the first stop position to the second stop position, based on the output of the position detecting part; and fifth program code means for setting an initial position of the carriage in the home position range based on the second transfer distance and the first stop position.

BRIEF DESCRIPTION OF THE DRAWINGS

The present invention will be understood more fully from the detailed description given herebelow and from the accompanying drawings of the preferred embodiments of the invention. However, the drawings are not intended to imply limitation of the invention to a specific embodement, but are for explanation and understanding only.

In the drawings.

DESCRIPTION OF THE PREFERRED EMBODIMENTS

Referring now to the accompanying drawings, the preferred embodiments of the present invention will be described below.

Figure 6:
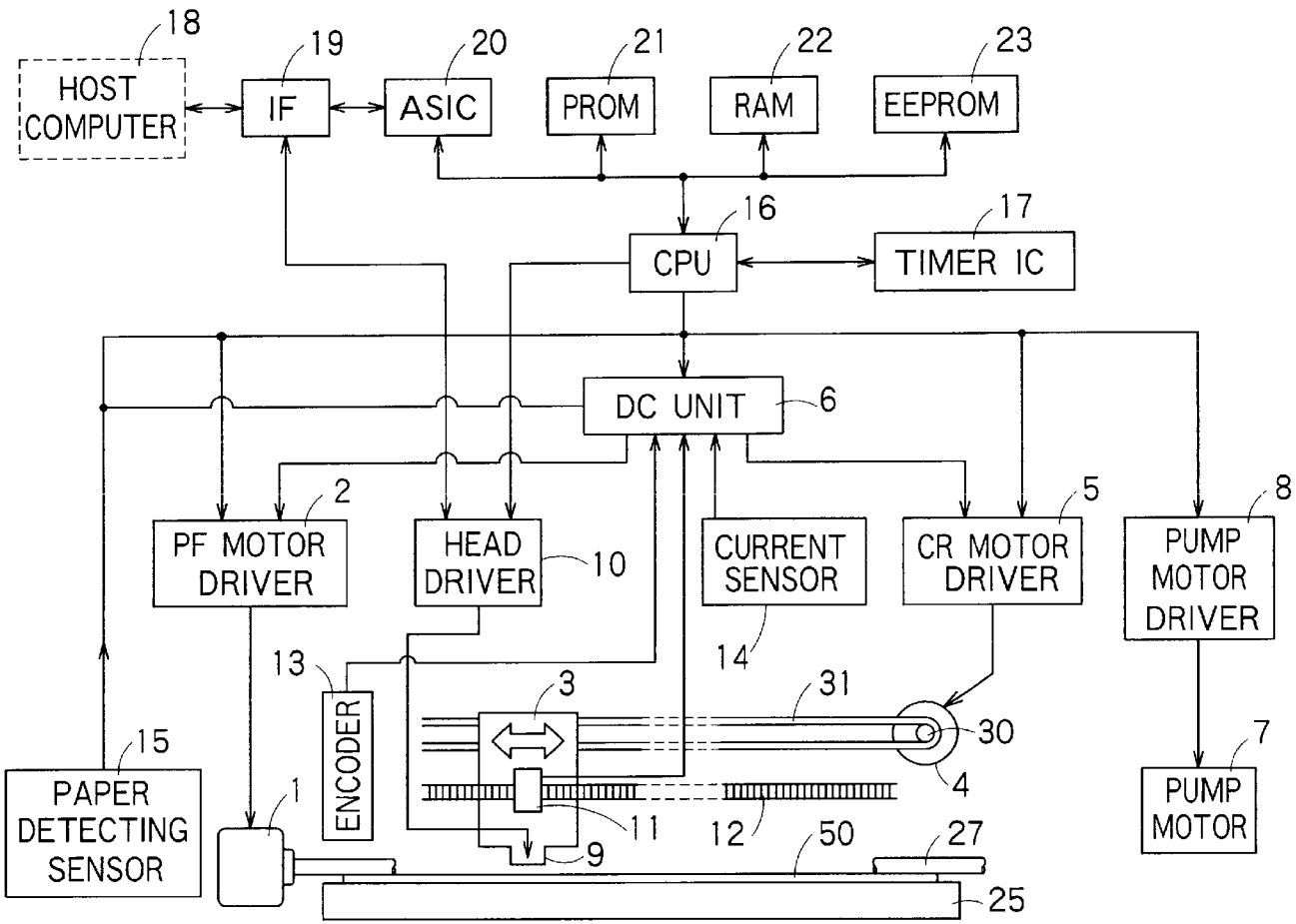
FIG. 6 is a block diagram schematically showing the construction of an ink jet printer.

First, the schematic construction of an ink jet printer in which a detecting apparatus for detecting a home position of a carriage is installed according to the present invention, will be described. The schematic construction of this ink jet printer is shown in FIG. 6.

This ink jet printer comprises: a paper feed motor (which will be also hereinafter referred to as a PF motor) 1 for feeding a paper; a paper feed motor driver 2 for driving the paper feed motor 1; a carriage 3; a carriage motor (which will be also hereinafter referred to as a CR motor) 4; a CR motor driver 5 for driving the carriage motor 4; a DC unit 6; a pump motor 7 for controlling the suction of ink for preventing clogging; a pump motor driver 8 for driving the pump motor 7; a recording head 9, fixed to the carriage 3, for discharging ink to a printing paper 50; a head driver 10 for driving and controlling the recording head 9; a linear type encoder 11 fixed to the carriage 3; a code plate 12 which has slits in regular intervals; a rotary type encoder 13 for use in the PF motor 1; a current sensor 14 for detecting a current flowing through the carriage motor 4; a paper detecting sensor 15 for detecting the position of the rear edge of a paper which is being printed; a CPU 16 for controlling the whole printer; a timer IC 17 for periodically generating an interruption signal to output the signal to the CPU 16; an interface part (which will be also hereinafter referred to as an IF) 19 for transmitting/receiving data to/from a host computer 18; an ASIC 20 for controlling the printing definition, the driving waveform of the recording head 9 and so forth on the basis of printing information which is fed from the host computer 18 via the IF 19; a PROM 21, RAM 22 and EEPROM 23 which are used as working and program storing regions for the ASIC 20 and the CPU 16; a platen 25 for supporting the paper 50 during print; a carrier roller 27, driven by the PF motor 1, for carrying the printing paper 50; a pulley 30 mounted on the rotating shaft of the CR motor 4; and a timing belt 31 driven by the pulley 30.

Furthermore, the DC unit 6 is designed to drive and control the paper feed motor driver 2 and the CR motor driver 5 on the basis of a control command, which is fed from the CPU 16, and the outputs of the encoders 11 and 13. In addition, each of the paper feed motor 1 and the CR motor 4 comprises a DC motor.

Figure 7:
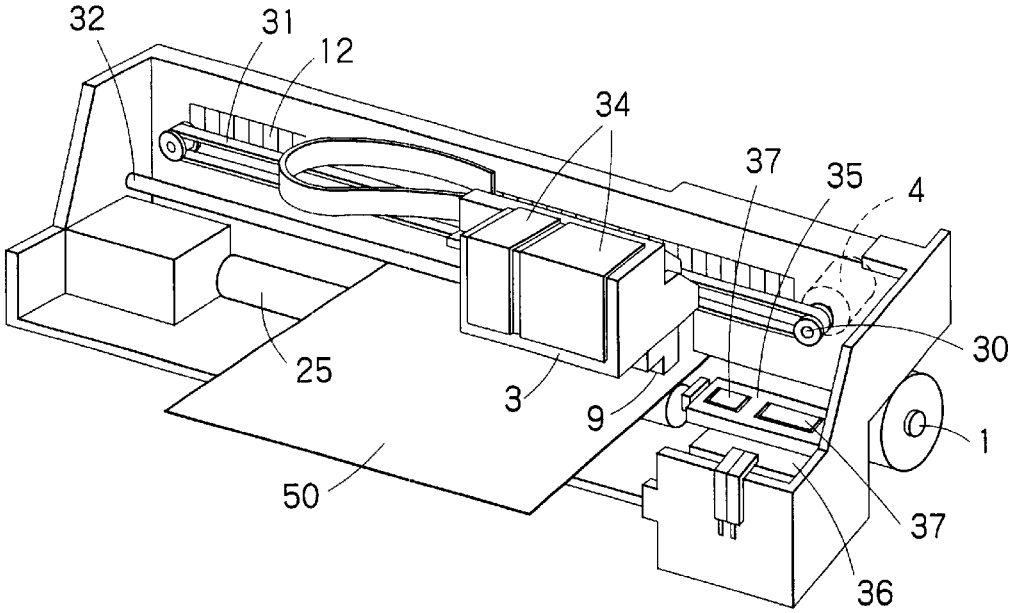
FIG. 7 is a perspective view showing the peripheral construction of a carriage.

The peripheral construction of the carriage 3 of this ink jet printer is shown in FIG. 7.

The carriage 3 is connected to the carriage motor 4 via the timing belt 31 and the pulley 30 to be driven so as to be guided by a guide member 32 to move in parallel to the platen 25. The carriage 3 is provided with the recording head 9 on the surface facing the printing paper. The recording head 9 comprises a nozzle row for discharging a black ink and a nozzle row for discharging color inks. Each nozzle is supplied with ink from an ink cartridge 34, and discharges drops of ink to the printing paper to print characters and/or images.

In a non-print region of the carriage 3, there are provided a capping unit 35 for sealing a nozzle opening of the recording head 9 during non-print, and a pump unit 36 having the pump motor 7 shown in FIG. 6. When the carriage 3 moves from a print region to the non-print region, the carriage 3 contacts a lever (not shown) to move the capping unit 35 upwards to seal the recording head 9.

When the nozzle opening row of the recording head 9 is clogged with ink, or when the cartridge 34 is exchanged or the like to force the recording head 9 to discharge ink, the pump unit 36 is operated in the sealed state of the recording head 9, to suck ink out of the nozzle opening row by a negative pressure from the pump unit 36. Thus, dust and paper powder adhering to a portion near the nozzle opening row are cleaned. Moreover, bubbles of the recording head 9, together with ink, are discharged to a cap 37.

Figure 8:
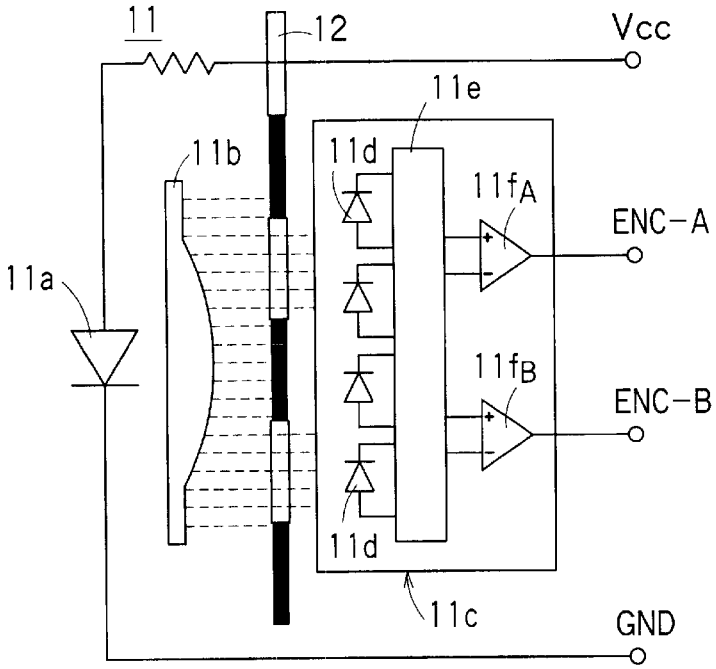
FIG. 8 is a schematic view showing the construction of a linear type encoder.

Then, the construction of the linear type encoder 11 mounted on the carriage 3 is shown in FIG. 8. This encoder 11 comprises a light emitting diode 11*a*, a collimator lens 11*b*, and a detection processing part 11*c*. The detection processing part 11*c* has a plurality of (four) photodiodes 11*d*, a signal processing circuit 11*e*, and two comparators $\mathbf{11}f_A$ and $\mathbf{11}f_B$.

When a voltage Vcc is applied between both ends of the light emitting diode 11*a* via a resistor, light rays are emitted from the light emitting diode 11*a*. The light rays are collimated by the collimator lens 11*b* to pass through the code plate 12. The code plate 12 is provided with slits at regular intervals (e.g., every 1/180 inches (=1/180×2.54 cm)).

The parallel rays passing through the code plate 12 are incident on each of the photodiodes 11*d* via a fixed slit (not shown), and converted into electric signals. The electric signals outputted from the four photodiodes 11*d* are processed by the signal processing circuit 11*e*. The signals outputted from the signal processing circuit 11*e* are compared by the comparators $\mathbf{11}f_A$ and $\mathbf{11}f_B$, and the compared results are outputted as pulses. The pulses ENC-A and ENC-B outputted from the comparators $\mathbf{11}f_A$ and $\mathbf{11}f_B$ are outputs of the encoder 11.

Figure 9:
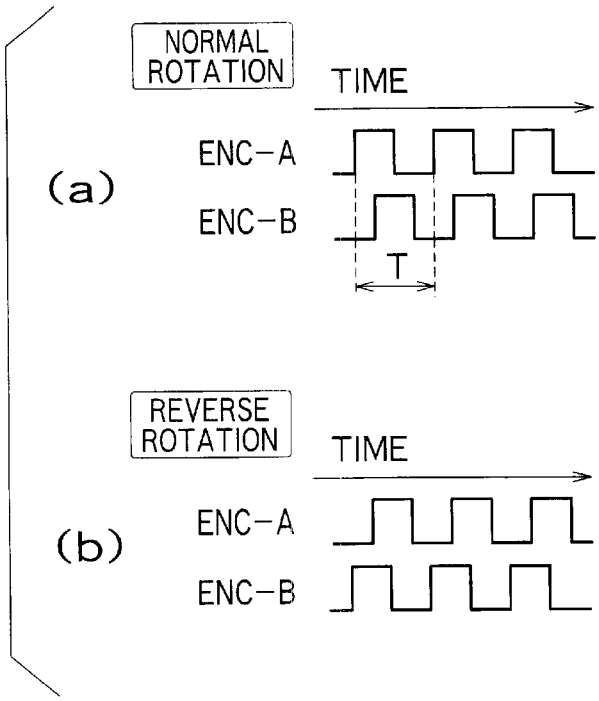
FIGS. 9(*a*) and 9(*b*) are waveform illustrations of output pulses of an encoder.

The phase of the pulse ENC-A is different from the phase of the pulse ENC-B by 90 degrees. The encoder 4 is designed so that the phase of the pulse ENC-A is advanced from the pulse ENC-B by 90 degrees as shown in FIG. 9(*a*) when the CR motor 4 is normally rotating, i.e., when the carriage 3 is moving a main scanning direction, and the phase of the pulse ENC-A lags behind the pulse ENC-B by 90 degrees as shown in FIG. 9(*b*) when the CR motor 4 is reversely rotating. One period T of the pulses corresponds to the distance between adjacent slits of the code plate 12 (e.g., 1/180 inches (=1/180×2.54 cm)). This is equal to a period of time, in which the carriage 3 moves between the adjacent slits.

On the other hand, the rotary type encoder 13 for use in the PF motor 1 has the same construction as that of the linear type encoder 11, except that the code plate is a rotating disk which rotates in accordance with the rotation of the PF motor 1. Furthermore, in the ink jet printer, the distance between adjacent slits of a plurality of slits provided in the code plate of the encoder 13 for use in the PF motor is 1/180 inches (=1/180×2.54 cm). When the PF motor 1 rotates by the distance between adjacent slits, the paper is fed by 1/1440 inches (=1/1440×2.54 cm).

Figure 10:
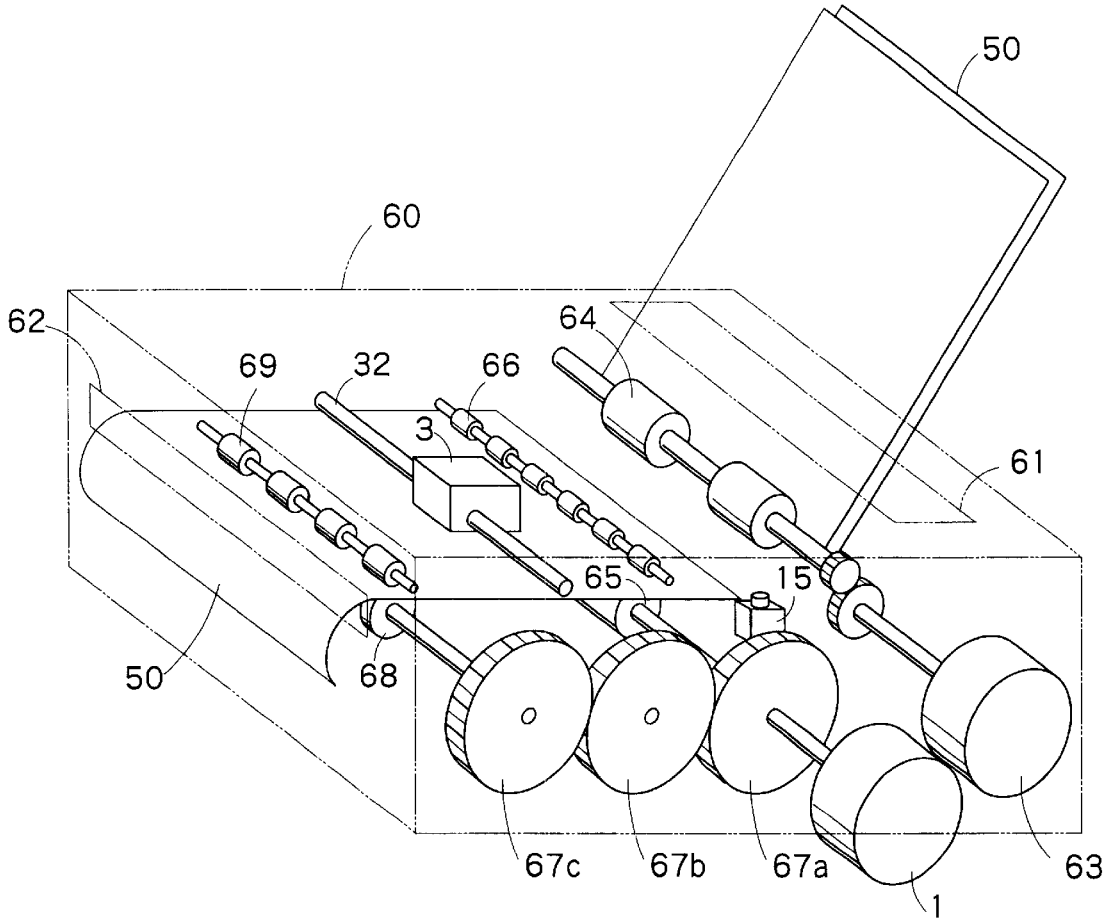
FIG. 10 is a perspective view of a printer illustrating the location of a paper detecting sensor.

Referring to FIG. 10, the position of the paper detecting sensor 15 shown in FIG. 6 will be described below.

In FIG. 10, the paper 10 inserted into a paper feeding port 61 of a printer 60 is fed into the printer 60 by means of a paper feeding roller 64 which is driven by a paper feeding motor 63. The front edge of the paper 50, which has been fed into the printer 60, is detected by, e.g., an optical paper detecting sensor 15. The paper 50, the front edge of which has been detected by the paper detecting sensor 15, is fed by means of a paper feed roller 65 and a driven roller 66 which are driven by the PF motor 1.

Subsequently, ink drops from the recording head (not shown), which is fixed to the carriage 3 moving along the carriage guide member 32, to carry out a print. Then, when the paper is fed to a predetermined position, the rear edge of the paper 50, which is currently being printed, is detected by the paper detecting sensor 15. Then, a gear 67*c* is driven, via a gear 67*b*, by means of a gear 67*a* which is driven by the PF motor 1. Thus, a paper discharging roller 68 and a driven roller 69 are rotated to discharge the printed paper 50 from a paper discharging port 62 to the outside.

First Preferred Embodiment

Figure 1:
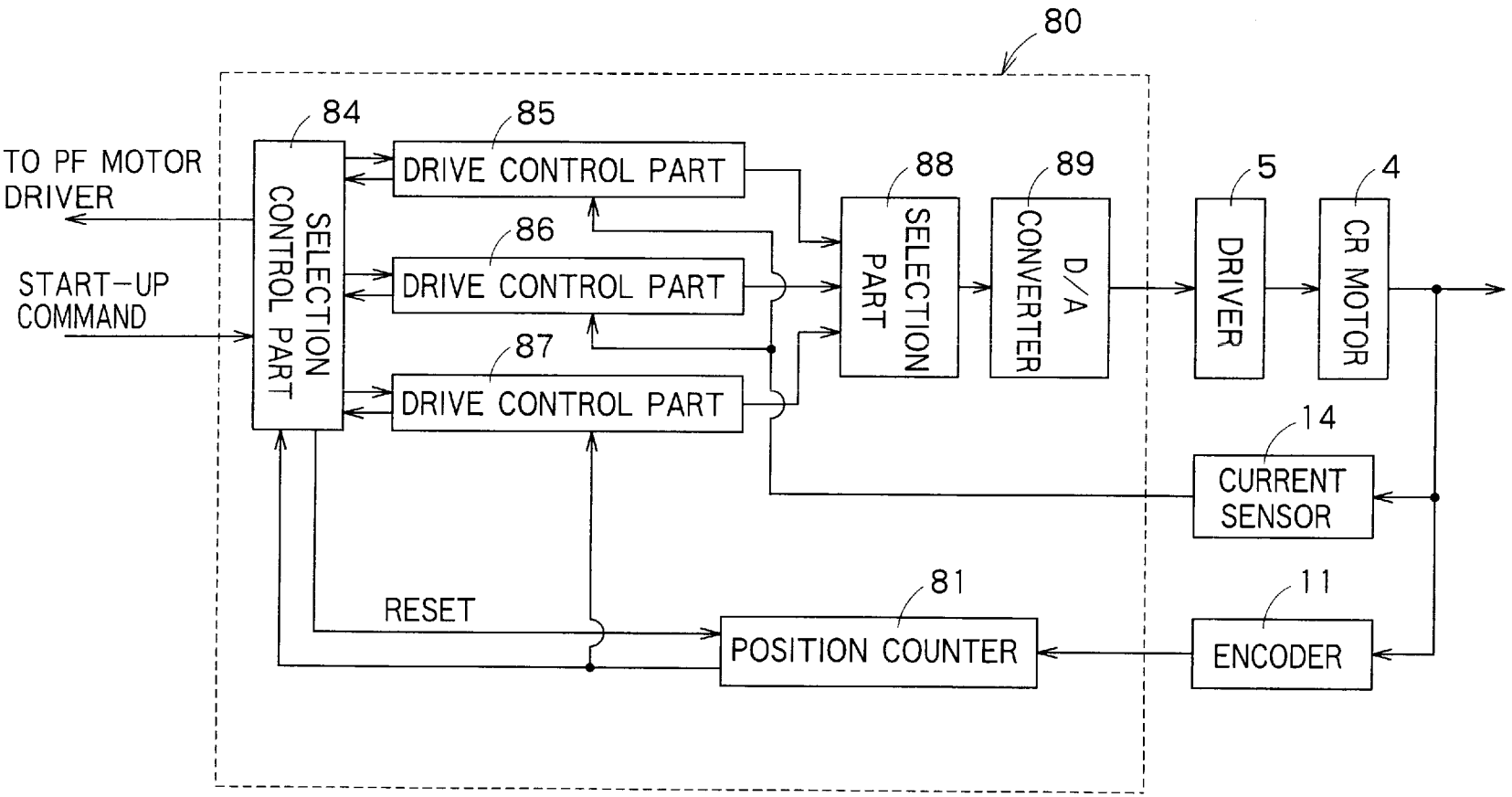
FIG. 1 is a block diagram showing the construction of a preferred embodiment of a home position detecting apparatus according to the present invention.

The first preferred embodiment according to the present invention will be described with reference FIG. 1. The first embodiment is an apparatus for detecting the home position of a carriage, and its configuration is shown in FIG. 1.

A detecting apparatus 80 in this embodiment is installed in the DC unit 6 described with reference to FIG. 6. The detecting apparatus 80 is provided with a position counter 81, a selection control part 84, drive control parts 85, 86 and 87, a selection part 88 and a D/A converter 89.

The position counter 81 is designed to detect the leading and trailing edges of each of the output pulses ENC-A and ENC-B of the encoder 11 to count the number of the detected edges, and to calculate the position of the carriage 3 on the basis of the counted value. In this counting, when the CR motor 4 is normally rotating, when one edge is detected, "+1" is added, and when the CR motor 4 is reversely rotating, if one edge is detected, "−1" is added. In other words, the position counter 81 is an up-down counter. Each of the periods of the pulses ENC-A and ENC-B is equal to the distance between adjacent slits of the code plate 12, and the phase of the pulse ENC-A is different from the phase of the pulse ENC-B by 90 degrees. Therefore, the counted value "1" in the above described counting corresponds to ¼ of the distance between adjacent slits of the code plate 12. Thus, if the counted value is multiplied by ¼ of the distance between adjacent slits, it is possible to obtain the moving amount of the carriage 3 from a position corresponding to a counted value "0". At this time, the definition of the encoder 11 is ¼ of the distance between adjacent slits of the code plate 12. If the distance between adjacent slits is 1/180 inches (=1/180×2.54 cm), the definition is 1/720 inches (=1/720×2.54 cm).

The selection control part 85 resets a counted value of the position counter 81 and also selectively turns on the drive control part 85 based on a start-up command fed from the CPU 16. One of the drive control parts 85 to 87 is selected and turned on afterward based on the result of control and the output of the position counter 81.

The selection control part 85 outputs a current value for transferring the carriage 3 from left to right, and controls the carriage motor 4 so that it is driven at a short-braking operation based on the output of the current sensor 14 when the current value fed to the carriage motor 4 reaches a value equal to or larger than a predetermined value, such as, 720 mA. This control is informed to the selection control part 84.

Figure 2:
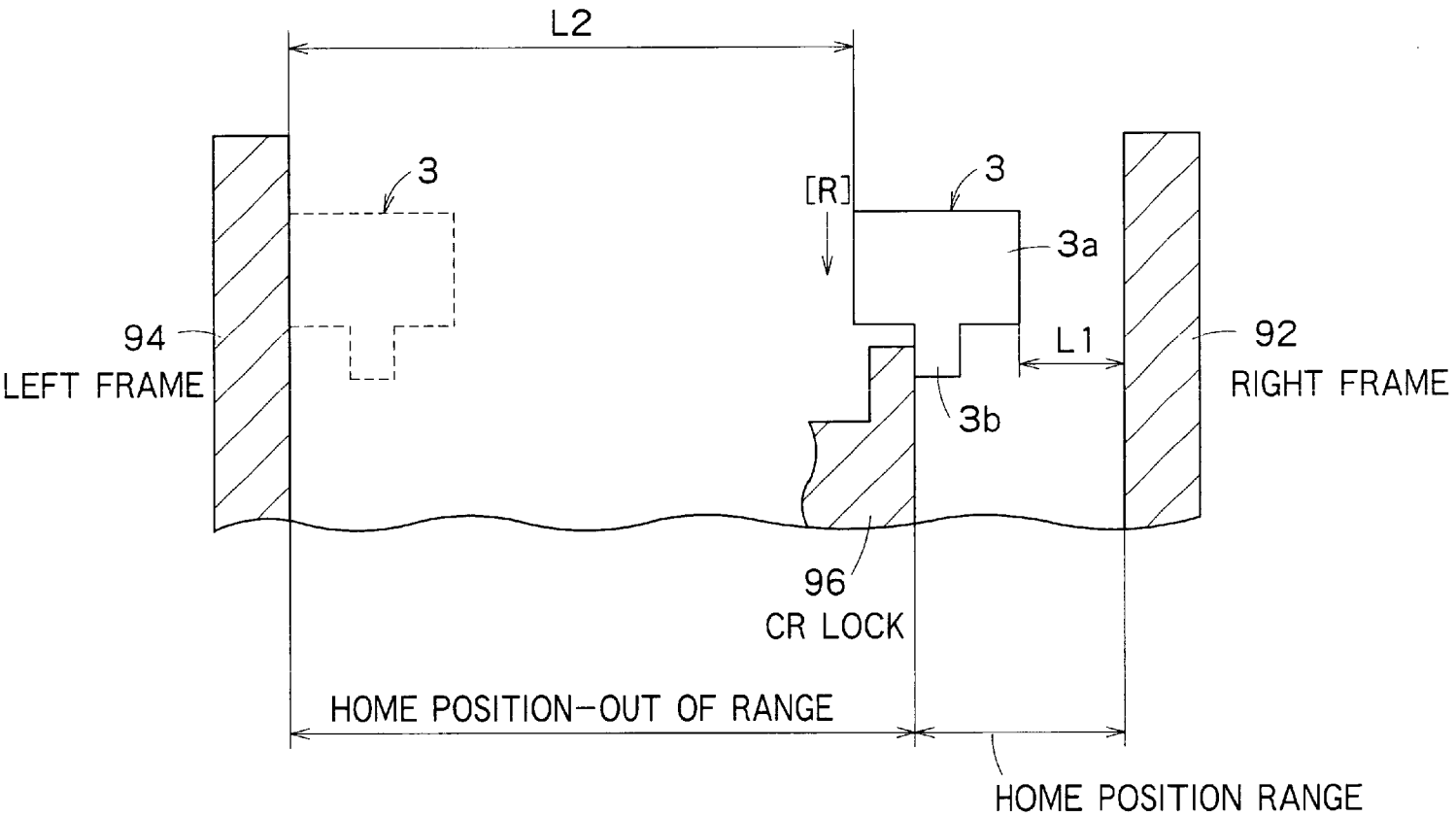
FIG. 2 illustrates a transferable range of a carriage.

FIG. 2 illustrates transfer of the carriage 3 from left to right. When the carriage 3 is located within a home position range, the carriage 3 is transferred so that the side face of a carriage body 3*a* will touch a right frame 92 (provided outside the home position range) of the printer. On the other hand, when the carriage 3 is located in a home position-out of range, the carriage 3 is transferred so that a protrusion 3*a* formed at the bottom of the carriage body 3*a* will touch a carriage lock 96 or, when the lock 96 is unhooked, the side face of the carriage body 3*a* will touch the right frame 92.

While the carriage 3 is located within the home position range, it is locked by the carriage lock 96 so as not to move to the home position-out of range. The carriage lock 96 can be turned on by reverse operation of the PF motor 1.

The selection control part 86 outputs a current value for transferring the carriage 3 from right to left, and controls the carriage motor 4 so that it is driven at a short-braking operation based on the output of the current sensor 14 when the current value fed to the carriage motor 4 reaches a value equal to or larger than a predetermined value, such as, 500 mA. This control is informed to the selection control part 84.

Transfer of the carriage 3 from right to left is also illustrated in FIG. 2. When the carriage 3 is located within the home position range, the carriage 3 is transferred so that the protrusion 3*a* of the carriage 3 will touch the carriage lock 96 or when the lock 96 is unhooked, the side face of the carriage body 3*a* will touch a left frame 94 (provided opposite the frame at the home position range side). On the other hand, when the carriage 3 is located in the home position-out of range, the carriage 3 is transferred so that the side face of the carriage body 3*a* will touch the left frame 94.

The drive control part 87 outputs a current value for transferring the carriage 3 to a predetermined position [R] shown in FIG. 2, close to the home position range.

The selection part 88 feeds the output of the drive control part selected by the selection control part 84 to the D/A converter 89.

The D/A converter 89 converts a digital current value, the output of the selection part 88, into an analog current value. Based on the analog current value, the driver 5 drives the carriage motor 4.

The driver 5 has, e.g., four transistors. By turning each of the transistors ON and OFF on the basis of the output of the D/A converter 89, the driver 5 can be selectively in (a) an operation mode in which the CR motor 4 is normally or reversely rotated, (b) a regenerative brake operation mode (a short brake operation mode, i.e., a mode in which the stopping of the CR motor is maintained), or (c) a mode in which the CR motor is intended to be stopped.

Figure 3:
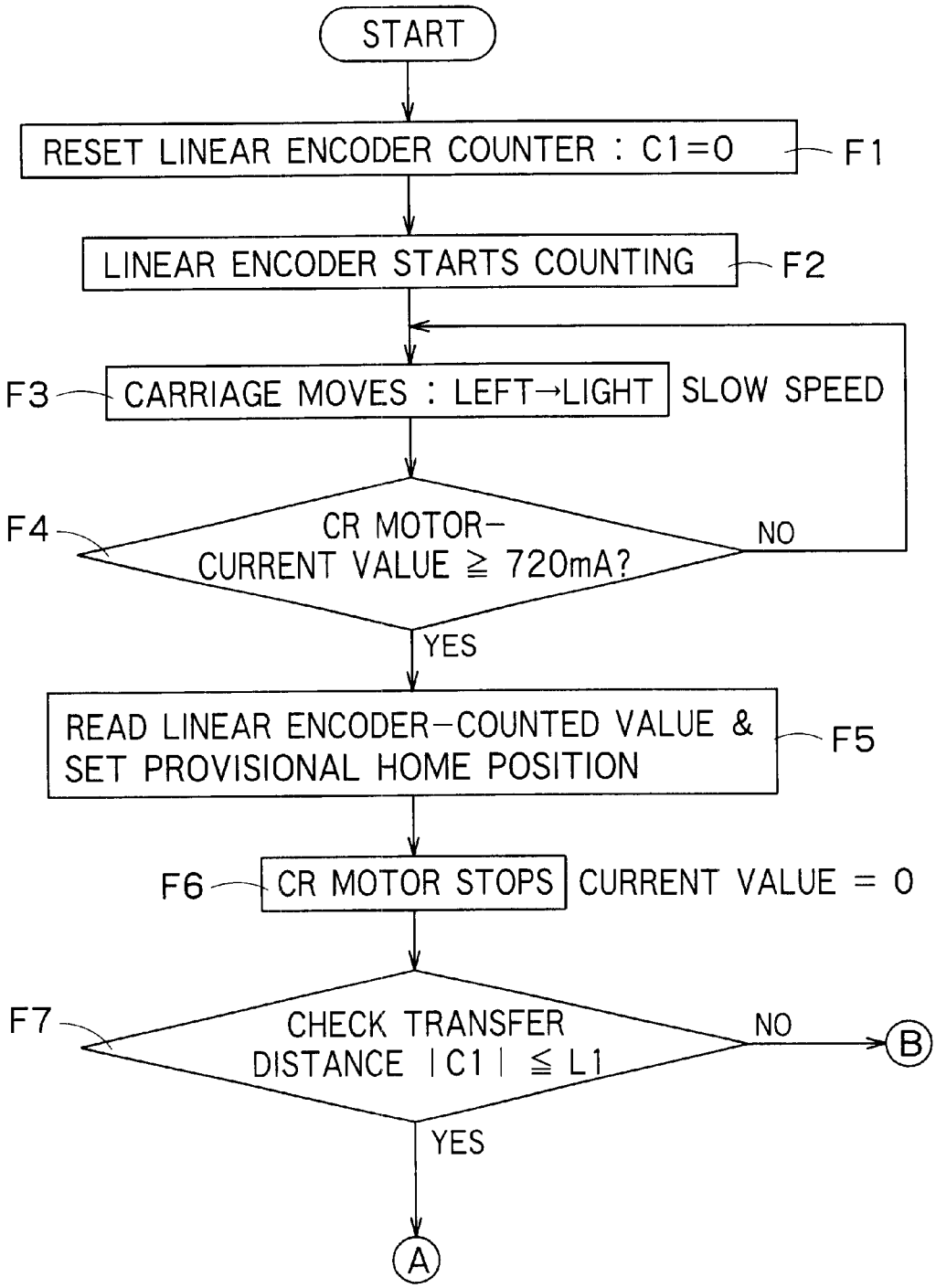
FIG. 3 is a flow chart explaining an operation of the home position detecting apparatus shown in FIG. 1.
Figure 4:
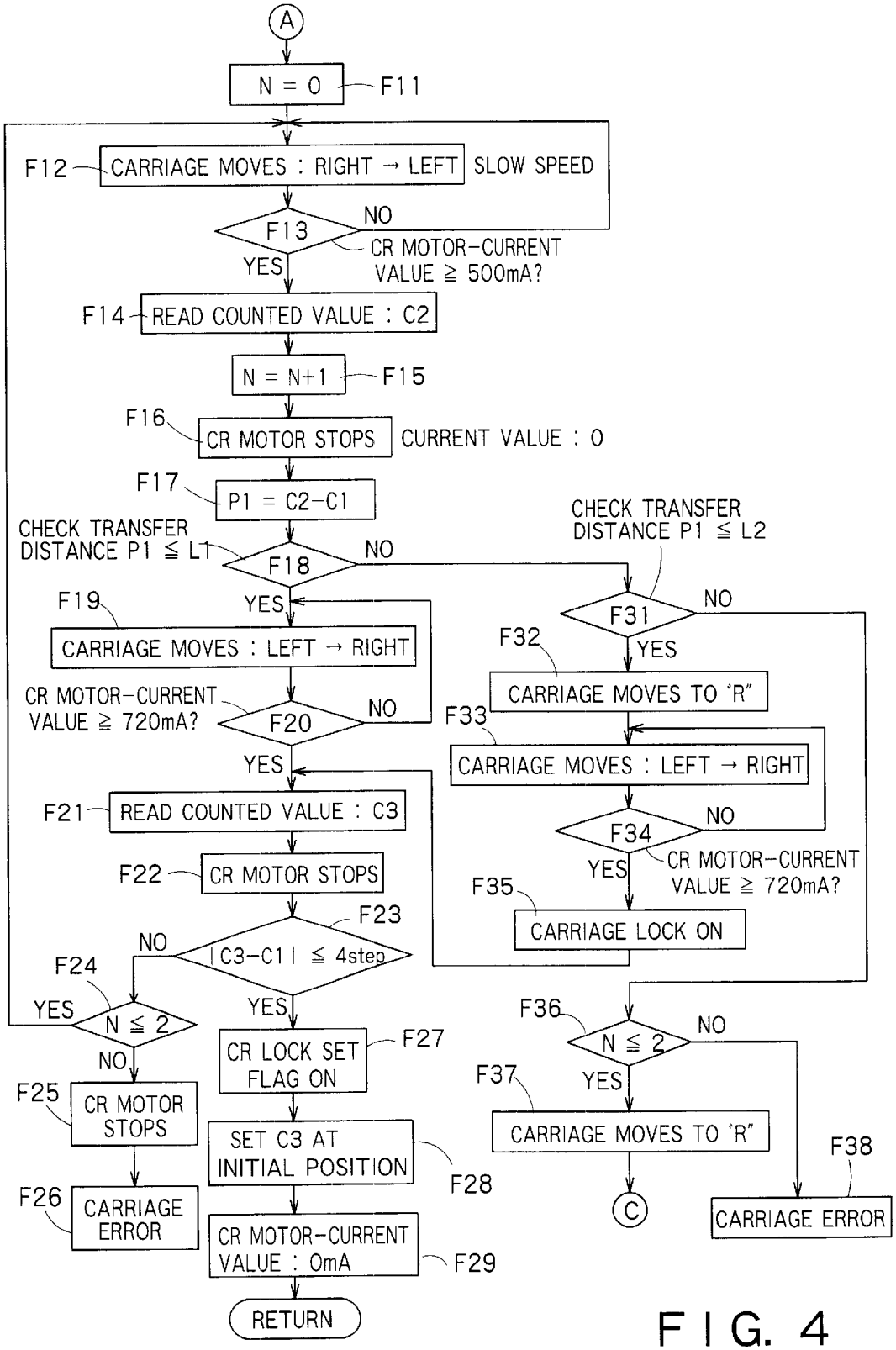
FIG. 4 is another flow chart explaining an operation of the home position detecting apparatus shown in FIG. 1.
Figure 5:
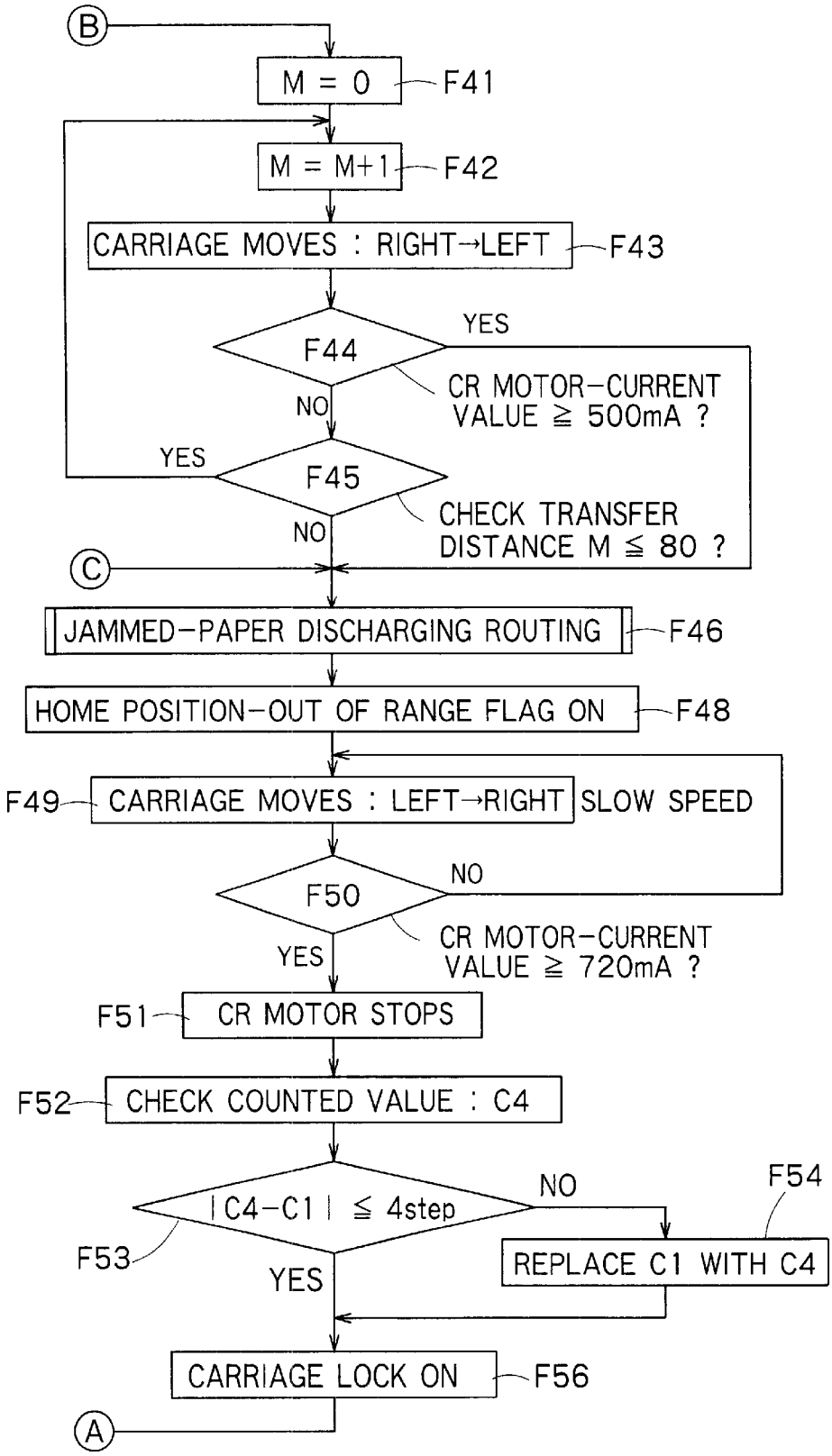
FIG. 5 is still another flow chart explaining an operation of the home position detecting apparatus shown in FIG. 1.

An operation of the hone position detecting apparatus 80 will be described with reference to FIGS. 3 to 5. FIGS. 3 to 5 show flow charts explaining an operation of the home position detecting apparatus in this embodiment.

When a start-up command is fed from the CPU 6 shown in FIG. 6 to the home position detecting apparatus 80, a counted value C1 of the position counter 81 is reset to "0" by the selection control art 84 (see step F1 in FIG. 3). The drive control part 85 is then selected and turned on by the selection control part 84. This initiates the carriage 3 to move from left to right and the position counter 81 to count the output pulses of the encoder 11 (see steps F2 and F3 in FIG. 3). The carriage 3 moves at a very slow speed, such as, 5 cps (character per second).

The control of carriage transfer from left to right is performed by controlling the carriage motor 4 by the drive control part 85 via the D/A converter 89 and the driver 5 until the current value fed to the carriage motor 4 reaches 720 mA or larger (see steps F3 and F4 in FIG. 3).

Once the current value fed to the carriage motor 4 reaches 720 mA or larger, this is informed from the drive control part 85 to the selection control part 84. The selection control part 84 then reads the counted value C1 of the position counter 81 to set a provisional home position (see step F5 in FIG. 3).

The drive control part 85 further controls the carriage motor 4 so that it is driven at a current value "0" in a short-brake operation mode (see step F6 in FIG. 3).

When the current value of the carriage motor 4 reaches 720 mA or larger, it is supposed that the carriage body 3*a* has touched the right frame 92 or the protrusion 3*b* formed at the bottom of the carriage 3 has touched the carriage lock 96.

Next, the selection control part 84 calculates the distance of carriage transfer |C1| (the absolute value of the counted value) and determines whether the distance is equal to or smaller than a predetermined value L1 (see step F7 in FIG. 3). The value L1 is the maxim value of the distance by which the carriage 3 can be transferred within the home position range, as shown in FIG. 2.

When the distance of carriage transfer |C1| is judged as equal to or smaller than the value L1, it is supposed that the carriage 3 was initially (C1=0) located in the home position range and has now touched the right frame 92 or it was initially located in the home position-out of range and has now touched the carriage lock 96. Then, the process goes to step F11 in FIG. 4.

On the other hand, when the distance of carriage transfer |C1| is judged as larger than the value L1, it is supposed that the carriage 3 was initially located in the home position-out of range and has now touched the carriage lock 96 or it has passed through the lock 96 and touched the right frame 92 because the lock 96 was unhooked. Then, the process goes to step F41 in FIG. 5 (See step F7 in FIG. 3).

Next, in step F11 shown in FIG. 4, the selection control part 84 sets a parameter N at "0". The selection control part 84 then selects and turns on the drive control part 86 to transfer the carriage 3 from right to left at a very slow speed (See step F12 in FIG. 4). The control of carriage transfer from right to left is performed by controlling the carriage motor 4 by the drive control part 86 via the D/A converter 89 and the driver 5 until a current value fed to the carriage motor 4 reaches 500 mA or larger (See steps F12 and F13 in FIG. 4).

When the current value fed to the carriage motor 4 reaches 500 mA or larger, this is informed by the drive control part 86 to the selection control part 84. The selection control part 84 reads a counted value C2 of the position counter 81 at this time, and adds "1" to the parameter N (see steps F14 and F15 in FIG. 4). The carriage motor 4 is controlled by the drive control part 86 at a current value "0" in the short-brake operation mode (See step F16 in FIG. 4).

When the current value fed to the carriage motor 4 reaches 500 mA or larger, it is supposed that the carriage 3 has touched the carriage lock 94 or the left frame 94 of the printer, or the carriage 3 has touched a jammed sheet of paper in the home position-out of range.

Next, the selection control part 84 calculates the distance of carriage transfer P1 (=C2−C1) (the difference between counted values) in step F17, then, it is determined whether the distance of carriage transfer P1 is equal to or smaller than the predetermined value L1 (See step F18).

When the distance of carriage transfer P1 is judged as equal to or smaller than the value L1, or it is supposed that the carriage 3 has touched carriage lock 96, the selection control part 85 selects and turns on the drive control part 85 to transfer the carriage 3 from left to right at a very slow speed (See step F19).

The control of carriage transfer from left to right continues until the current value fed to the carriage motor 4 reaches 720 mA or larger (See steps F19 and F20).

Once the current value fed to the carriage motor 4 reaches 720 mA or larger, this is informed to the selection control part 84 from the drive control part 85. The selection control part 84 then reads a counted value C3 of the position counter 81 at this time (See step F21). The carriage motor 4 is controlled by the drive control part 85 in the short-brake operation mode (See step F21).

The selection control part 81 calculates the absolute value |C3−C1| of the difference between the value C1 counted by the position counter 81 in step F5 and the value C3 counted by the position counter 81 in step F21. It is determined whether the absolute value is equal to or smaller than a counted value, such as, 16 that corresponds 4 steps, or $4\times 1/180$ inches ($4\times 1/180\times 2.54$ cm) in step F23.

When the absolute value goes over the 4 steps, the process goes to step F24 in which the selection control part 84 determines whether the parameter N is 2 or smaller.

When the parameter N is 2 or smaller, the process returns to step F12 to repeat the steps described above.

On the other hand, when the parameter N is larger than 2, the carriage motor 3 is stopped (see step F25), the selection control part 84 outputs a carriage error message to the outside. Then, the home position detecting process ends.

In step F23, when the absolute value |C3−C1| is 4 steps or smaller, a CR lock set flag is turned on (step F27), which indicates that carriage lock 96 has been set by the selection control part 84.

Then, the counted value C3 of the position counter 81 that has been read in step F21 is reset to the initial position by the selection control part 84 to decide the home position (see step F28). The current value fed to the carriage motor 4 is then set at "0", and the home position detecting process ends (see step F29).

In step F18, when the distance of carriage transfer P1 is larger than the predetermined value L1, the process goes to step F31. The selection control part 84 determines whether the transfer distance P1 is equal to or larger than a predetermined value L2 (step F31). The value L2 is shown in FIG. 2, which is used for determination of whether or not the carriage 3 is located in the home position-out of range.

In step F31, when the transfer distance P1 is equal to or larger than the value L2, the selection control part 84 selects and turns on the drive control part 87. The drive control part 87 then transfers the carriage 3 to the predetermined position [R] close to the home position range shown in FIG. 2 (see step F32).

The selection control part 84 then selects and turns on the drive control part 85. The drive control part 85 transfers the carriage 3 from left to right (see step F33). The control of carriage transfer from left to right continues until the current value fed to the carriage motor 4 reaches 720 mA or larger (see steps F33 and F34).

When the current value fed to the carriage motor 4 reaches 720 mA or larger, it is supposed that the carriage 3 has touched the right frame of the printer. The selection control part 84 then feeds a command signal to the driver 2 of the PF motor 1, to drive the motor 1 for reverse rotation to turn on the carriage lock 96 so that the carriage 3 stays in the home position range (see step F35). The process then goes to step F21 to execute the step described above.

On the other hand, when the transfer distance P1 is smaller than the predetermined value L2 in step F31, the selection control part 84 determines whether or not the parameter N is larger than 2. If so, the selection control part 84 outputs a carriage error message to the outside (see step F38), and the process ends. If it is smaller than 2, the selection control part 84 selects and turns on the drive control part 87. The drive control part 87 then transfers the carriage 3 to the predetermined position [R] close to the home position range in FIG. 2 (see step F37). The process then goes to step F46 shown in FIG. 5.

In step F7 shown in FIG. 3, when the transfer distance |C1| is larger than the predetermined value L1, the process goes to step F41 shown in FIG. 5. In step F41, the selection control part 84 sets a parameter M at "0", and in step F42, the value "1" is added to the parameter M.

The selection control part 84 then selects and turns on the drive control part 86 to transfer the carriage 3 from right to left (see step F43). The control of carriage transfer from right to left is performed while the drive control part 86 is watching the current value fed to the carriage motor 4 and the selection control part 84 is watching the transfer distance of the carriage 3 (see steps F43, F44 and F45). The transfer distance is given by the number M of the slits of the code plate 12 installed in the encoder 11, through which the carriage 3 has passed.

The process goes to step F46 only when the current value fed to the carriage motor 4 reaches 500 mA or larger or the number M of the slits through which the carriage 3 has passed reaches 80 or larger.

In step F46, the selection control part 84 feeds a command signal to the driver 2 of the PF motor 1 for executing a jammed-paper discharging routine. The carriage lock 96 has been unhooked at this time.

The selection control part 84 then turns on a flag indicating that the carriage 3 had been located in the home position-out of range before power-on (see step F48) for cleaning of a nozzle of the recording head 9 before the printing process.

The selection control part 84 selects and turns on the drive control part 85 to transfer the carriage 3 from left to right at a very slow speed (see step F49). The control of carriage transfer from left to right continues until the current value fed to the carriage motor 4 reaches 720 mA or larger.

When the carriage motor 4 reaches 720 mA or larger, the drive control part 85 controls the carriage motor 4 in the short-brake operation mode, and the selection control part 84 reads a counted value C4 of the position counter 81 at this time (see steps F51 and F52).

The selection control part 84 calculates the absolute value |C4−C1| of the difference between the counted value C4 and the counted value C1 read in step F5 shown in FIG. 3. The selection control part 84 then determines whether the absolute value |C4−C1| is equal to or smaller than the counted value "16" that corresponds to the predetermined value 4 steps, or $4\times 1/180$ inches (see step F53). If so, the process directly goes to step F56, however, if not, the value C1 is replaced with C4 in step F54, and the process goes to step F56.

In step F56, the selection control part 84 feeds a command signal to the driver 2 of the PF motor 1 to rotate the PF motor 1 in the reverse direction. The carriage lock 96 is then turned on so that the carriage 3 remains in the home position range. The process then goes to step F11 shown in FIG. 4 to execute the steps already described.

In this embodiment, the carriage is transferred to left to right until the current value flowing through the carriage reaches 720 mA or larger, on the other hand, the carriage is transferred to right to left until the current value flowing through the carriage reaches 500 mA or larger. This current value judgement is performed based on the fact that the home position range is a load area.

As described above, the hone position of the carriage 3 can be detected based on the outputs of the encoder 11 and the current sensor 14, requiring no detector for solo use in home position detection, thus decreasing a manufacturing cost compared to conventional printers.

The current sensor 14 is a sensor that has been installed in general printers. Moreover, the position counter 81 is a counter that has been used in general printers for carriage motor-speed and -positioning control.

In this embodiment, the speed at which the carriage touches the printer frame is set equal to or slower than an acceptable speed. This acceptable speed is decided by the stiffness of the printer frame and an acceptable impact to a piezoelectric device attached to the recording head mounted on the carriage.

Moreover, this embodiment is described as applied to a printer with a DC motor as the carriage motor, however, the present invention is applicable to a printer with a motor other than a DC motor.

Second Preferred Embodiment

Figure 11:
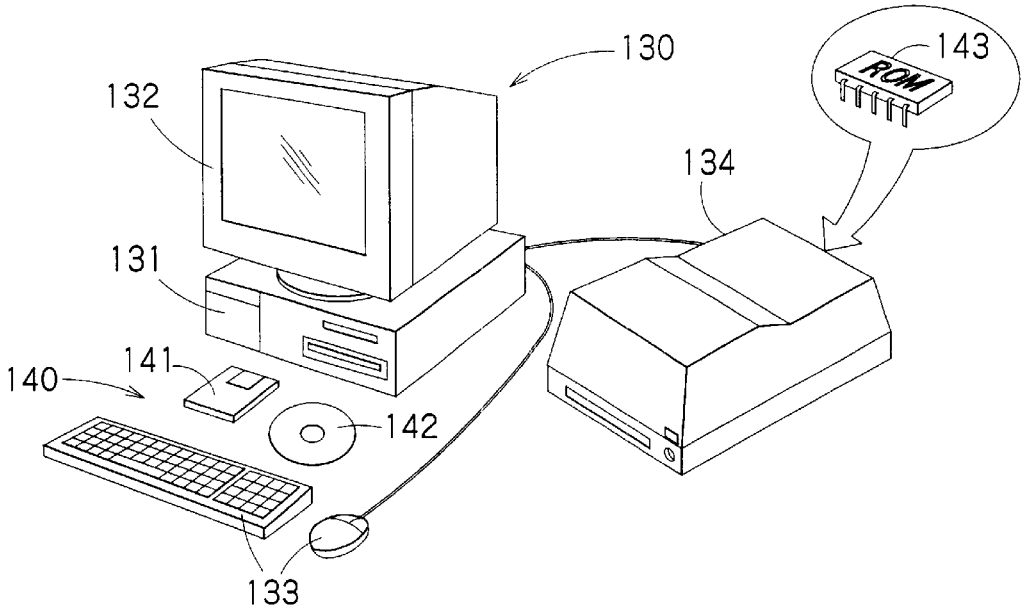
FIG. 11 is a perspective view of a computer system using a storage medium in which a print control program according to the present invention has been stored.
Figure 12:
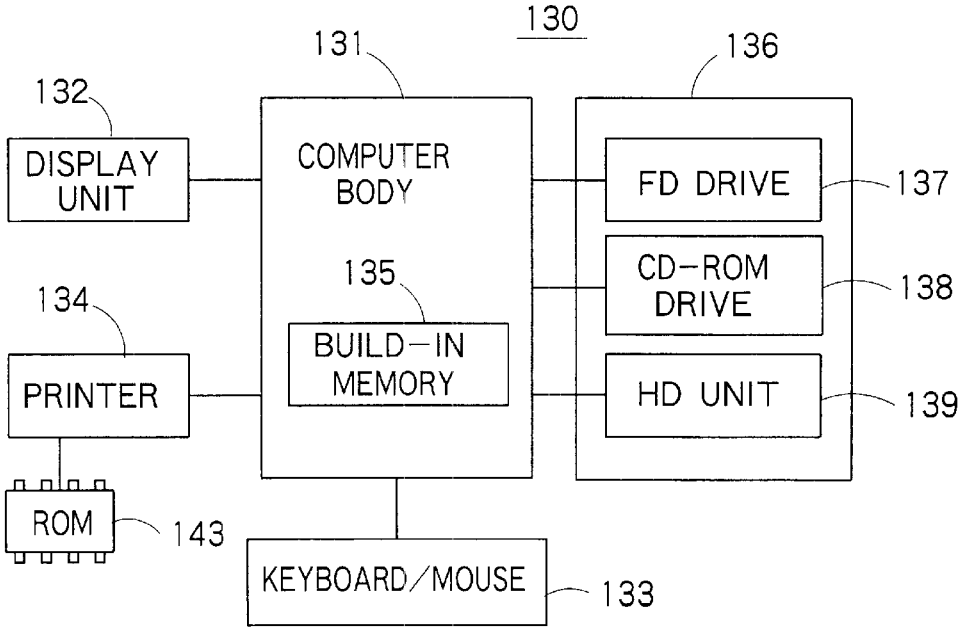
FIG. 12 is a block diagram of a computer system using a storage medium in which a print control program according to the present invention has been stored.

Referring to FIGS. 11 and 12, the second preferred embodiment of the present invention will be described below. This preferred embodiment relates to a storage medium, in which a detection program for detecting a home position of a carriage has been stored. FIGS. 11 and 12 are a perspective view and block diagram showing an example of a computer system 130 which uses a storage medium, in which a detection program for detecting a home position of a carriage in this preferred embodiment has been recorded.

In FIG. 12, the computer system 130 comprises a computer body 130 including a CPU, a display unit 132, such as a CRT, an input unit 133, such as a keyboard or mouse, and a printer 134 for carrying out a print.

As shown in FIG. 12, the computer body 131 comprises an internal memory 135 of a RAM, and a built-in or exterior memory unit 136. As the memory unit 136, a flexible or floppy disk (FD) drive 137, a CD-ROM drive 138 and a hard disk drive (HD) unit 139 are mounted. As shown in FIG. 11, a flexible disk or floppy disk (FD) 141 which is inserted into a slot of the FD drive 137 to be used, a CD-ROM 142 which is used for the CD-ROM drive 138, or the like is used as a storage medium 140 for use in the memory unit 136.

As shown in FIGS. 11 and 12, it is considered that the FD 141 or the CD-ROM 142 is used as the storage medium for use in a typical computer system. However, since this preferred embodiment relates to a control program for controlling a motor for use in the printer 134, the control program of the present invention may be recorded in, e.g., a ROM chip 143 serving as a nonvolatile memory which is built in the printer 134. Of course, the storage medium may be any one of FDs, CD-ROMs, MOs (Magneto-Optical) disks, DVDs (Digital Versatile Disks), other optical recording disks, card memories, and magnetic tapes.

The storage medium 140 in this embodiment stores program codes corresponding to the detecting steps F10 to F56 shown in FIGS. 3 to 5.

The storage medium 140 in this embodiment may store first program code of transferring a carriage driven by a motor toward a frame of a printer until being stopped, the frame being provided at a home position range side, second program code of obtaining a first stop position at which the carriage stops by the first program code means and a first transfer distance from a position at which the carriage starts to transfer to the first stop position, based on an output of a position detecting part for detecting a position of the carriage, third program code of transferring the carriage toward another frame of the printer until being stopped, the other frame being provided opposite to the frame provided at the home position range side, fourth program code of obtaining a second stop position at which the carriage stops by the third program code means and a second transfer distance in which the carriage transfers from the first stop position to the second stop position, based on the output of the position detecting part, and fifth program code of setting an initial position of the carriage in the home position range based on the second transfer distance and the first stop position.

As disclosed above, the present invention achieves less manufacturing cost with no detector for solo use in home position detection.

The present invention has been disclosed in terms of the preferred embodiment in order to facilitate better understanding thereof, it should be appreciated that the invention can be embodied in various ways without departing from the principle of the invention. Therefore, the invention should be understood to include all possible embodiments and modification to the shown embodiments which can be embodied without departing from the principle of the invention as set forth in the appended claims.

What is claimed is:

1. An apparatus for detecting a home position of a carriage comprising:

a position detecting part to detect a position of a carriage driven by a motor;

a first drive control part to control the motor so that the carriage is transferred toward a frame of a printer until being stopped, the frame being provided at a home position range side;

a second drive control part to control the motor so that the carriage is transferred toward another frame of the printer until being stopped, the other frame being provided opposite to the frame provided at the home position range side;

a third drive control part to control the motor so that the carriage is transferred to a predetermined position close to the home position range; and a selection control part to select one of the first, the second, and the third drive control parts and control the selected drive control part, thus detecting a home position of the carriage based on a result of the selective control and the output of the position detecting part.

2. The detecting apparatus, as set forth in claim 1, wherein the selection control part selects the first drive control part on reception of a start-up command to control the carriage, calculates a first transfer distance from a position at which the carriage starts to transfer under control by the first drive control part to a first stop position at which the carriage stops, based on the output of the position detecting part, and compares the first transfer distance and a first predetermined value that is the maximum value of a distance in which the carriage is transferable within the home position range, thus estimating a position of the carriage based on a result of the comparison.

3. The detecting apparatus, as set forth in claim 2, wherein, when the first transfer distance is equal to or smaller than the first predetermined value, the selection control part selects the second drive control part to control the carriage, calculates a second transfer distance from the first stop position to a second stop position to and at which the carriage transfers and stops under control by the second drive control part, based on the output of the position detecting part, thus comparing the second transfer distance and the first predetermined value.

4. The detecting apparatus, as set forth in claim 2, wherein, when the first transfer distance is larger than the first predetermined value, the selection control part selects the second drive control part to control the carriage until the carriage stops or transfers a predetermined distance or larger, succeedingly, feeds a command signal to a driver of a paper-feed motor for executing a jammed-paper discharging operation, succeedingly, selects the first drive control part to control the carriage to set a stop position at which the carriage stops under control by the first drive control part as a new first stop position only when the difference between the stop position and the first position is equal to or longer than a predetermined distance, succeedingly, selects the second drive control part to control the carriage, calculates a second transfer distance from the new first stop position to a second stop position at which the carriage stops under control by the second drive control part, and compares the second transfer distance and the first predetermined value.

5. The detecting apparatus, as set forth in claim 4, wherein the selection control part feeds the command signal to the driver of the paper-feed motor before selecting the second drive control part, to reversely rotate the paper-feed motor to lock the carriage.

6. The detecting apparatus, as set forth in claim 3, wherein, when the second transfer distance is larger than the first predetermined value, the selection control part compares the second transfer distance and a second predetermined value that is the maximum value of a distance in which the carriage is transferable outside the home position range.

7. The detecting apparatus, as set forth in claim 6, wherein, when the second transfer distance is smaller than the second predetermined value, the selection control part feeds a command signal to a driver of a paper-feed motor for executing a jammed-paper discharging operation after selecting the third drive control part to control the carriage, succeedingly, selects the first drive control part to control the carriage to set a stop position at which the carriage stops under control by the first drive control part as a new first stop position only when the difference between the stop position and the first position is equal to or larger than a predetermined distance, succeedingly, selects the second drive control part to control the carriage, calculates a second transfer distance from the new first stop position to a second stop position at which the carriage stops under control by the second drive control part, and compares the second transfer distance and the first predetermined value.

8. The detecting apparatus, as set forth in claim 7, wherein the selection control part feeds the command signal to the driver of the paper-feed motor before selecting the second drive control part, to reversely rotate the paper-feed motor to lock the carriage.

9. The detecting apparatus, as set forth in claim 6, wherein, when the second transfer distance is equal to or smaller than the second predetermined value, the selection control part selects the first drive control part to control the carriage after selecting the third drive control part, calculates a third stop position at which the carriage stops under control by the first drive control part, based on the output of the position detecting part, thus deciding the third stop position as an initial position in the home position range when the difference between the first stop position and the third stop position is equal to or smaller than a predetermined value.

10. The detecting apparatus, as set forth in claim 3, wherein, when the second transfer distance is equal to or smaller than the first predetermined value, the selection control part selects the first drive control part to control the carriage, calculates a third stop position at which the carriage stops under control by the first drive control part, based on the output of the position detecting part, thus deciding the third stop position as an initial position in the home position range when the difference between the first stop position and the third stop position is equal to or smaller than a predetermined value.

11. The detecting apparatus, as set forth in claim 1, wherein the position detecting part is an up-down counter to count pulses generated by an encoder in accordance with rotation of the motor, the selection control part resetting a counted value of the up-down counter on receiving a start-up command.

12. The detecting apparatus, as set forth in claim 1, wherein the motor is a DC motor, each of the first and the second drive control parts judging that the motor is stopping when a current value flowing through the motor reaches a predetermined current value or larger, to feed command signal to the selection control part.

13. A method of detecting a home position of a carriage comprising the steps of:

a first step of transferring a carriage driven by a motor toward a frame of a printer until being stopped, the frame being provided at a home position range side;

a second step of obtaining a first stop position at which the carriage stops by the first step and a first transfer distance from a position at which the carriage starts to transfer to the first stop position, based on an output of a position detecting part for detecting a position of the carriage;

a third step of transferring the carriage toward another frame of the printer until being stopped, the other frame being provided opposite to the frame provided at the home position range side;

a fourth step of obtaining a second stop position at which the carriage stops by the third step and a second transfer distance in which the carriage transfers from the first stop position to the second stop position, based on the output of the position detecting part; and a fifth step of setting an initial position of the carriage in the home position range based on the second transfer distance and the first stop position.

14. The detecting method, as set forth in claim 13, comprising the steps of:

a step of, following the second step, comparing the first transfer distance and a first predetermined value that is the maximum value in which the carriage is transferable within the home position range;

a step of going to the third step when the first transfer distance is equal to or smaller than the first predetermined value;

a step of, when the first transfer distance is larger than the first predetermined value, transferring the carriage toward the other frame provided opposite to the frame provided at the home position range side, when the carriage stops or a transfer distance of the carriage by the transferring becomes larger than a predetermined value, performing a jammed-paper discharging operation, succeedingly, transferring the carriage toward the other frame provided opposite to the frame provided at the home position range side until being stopped, succeedinlgly, locking the carriage, and going to the third step.

15. The detecting method, as set forth in claim 13, the fifth step of setting the initial position comprising the step of a step of comparing the second transfer distance and the first predetermined value.

16. The detecting method, as set forth in claim 15, wherein, when the second transfer distance is equal to or smaller than the first predetermined value, further comprising the steps of:

a step of transferring the carriage toward the frame provided at the home position range side until being stopped; and a step of obtaining a third stop position at which the carriage stops by the transferring step based on the output of the position detecting part, and setting the third stop position as the initial position when the difference between the first and the third stop positions is equal to or smaller than a predetermined value.

17. The detecting method, as set forth in claim 15, wherein, when the second transfer distance is larger than the first predetermined value, further comprising the step of comparing the second transfer distance and a second predetermined value that is the maximum value in which the carriage is transferable outside the home position range.

18. The detecting method, as set forth in claim 17, wherein, when the second transfer distance is equal to or larger than the second predetermined value, further comprising the steps of:

a step of transferring the carriage to a predetermined position close to the home position range;

a step of transferring the carriage toward the frame provided at the home position range side until being stopped;

a step of locking the carriage; and a step of obtaining a third stop position at which the carriage is stopped by the transferring step, and setting the third stop position as the initial position when the difference between the first and the third stop positions is equal to or smaller than a predetermined value.

19. The detecting method, as set forth in claim 17, wherein, when the second transfer distance is smaller than the second predetermined value, further comprising the steps of:

a step of transferring the carriage to a predetermined position close to the home position range;

a step of performing a jammed-paper discharging operation;

a step of transferring the carriage toward the frame provided at the home position range side until being stopped;

a step of locking the carriage; and a step of going to the third step.

20. The detecting method, as set forth in claim 13, wherein the motor is a DC motor, the carriage is judged as being stopped when a current value flowing through the motor reaches a predetermined current value or larger.

21. A computer-readable storage medium storing program code for detecting a home position of a carriage, comprising:

first program code means for transferring a carriage driven by a motor toward a frame of a printer until being stopped, the frame being provided at a home position range side;

second program code means for obtaining a first stop position at which the carriage stops by the first program code means and a first transfer distance from a position at which the carriage starts to transfer to the first stop position, based on an output of a position detecting part for detecting a position of the carriage;

third program code means for transferring the carriage toward another frame of the printer until being stopped, the other frame being provided opposite to the frame provided at the home position range side;

fourth program code means for obtaining a second stop position at which the carriage stops by the third program code means and a second transfer distance in which the carriage transfers from the first stop position to the second stop position, based on the output of the position detecting part; and fifth program code means for setting an initial position of the carriage in the home position range based on the second transfer distance and the first stop position.

* * * * *